United States Patent [19]

Krafutler

[11] Patent Number: 5,056,579

[45] Date of Patent: Oct. 15, 1991

[54] REINFORCING AND GUIDING BAR FOR A FLEXIBLE CURTAIN IN A VERTICALLY RAISABLE DOOR

[75] Inventor: Bernard Krafutler, Dunieres, France

[73] Assignee: Nergeco, Dunieres, France

[21] Appl. No.: 489,889

[22] Filed: Mar. 2, 1990

Related U.S. Application Data

[63] Continuation of Ser. No. 279,005, Dec. 2, 1988, abandoned.

[30] Foreign Application Priority Data

Dec. 2, 1987 [FR] France ..... 87 16700

[51] Int. Cl.[5] ..... A47G 5/00

[52] U.S. Cl. ..... 160/271; 160/264

[58] Field of Search ..... 160/271, 270, 272, 273.1, 160/264, 84.1, 266, 267, 268.1, 269

[56] References Cited

U.S. PATENT DOCUMENTS

| | | | |
|---|---|---|---|
| 236,126 | 12/1880 | Washburn | 160/273.1 X |
| 797,652 | 8/1905 | Wilson et al. | 160/273 X |
| 972,422 | 10/1910 | Whitmore | 160/264 X |
| 3,292,685 | 12/1966 | Clark | 160/264 X |
| 4,397,347 | 8/1983 | Brabant | 160/84.1 X |
| 4,547,014 | 10/1985 | Wicker | 160/84.1 X |
| 4,665,964 | 5/1987 | Zommers | 160/273.1 X |
| 4,776,379 | 10/1988 | Kraeutler | 160/84.1 |

*Primary Examiner*—David M. Purol

*Attorney, Agent, or Firm*—Sughrue, Mion, Zinn, Macpeak & Seas

[57] ABSTRACT

A reinforcing bar for stiffening and guiding a flexible curtain in a vertically raisable door is fixed horizontally to the curtain and each of its ends penetrates into a corresponding vertical guiding slideway (1). At each of its ends, the bar includes a zone of reduced mechanical strength to enable the bar to escape from the guideways (1) when it is subjected to a thrust of given force substantially perpendicularly to the curtain (2). The bar is constituted, for example, by tubular portion (3) having two protective end pieces (43) fitted to its respective ends, with the end pieces being designed to break at zones of weakness (433).

2 Claims, 1 Drawing Sheet

REINFORCING AND GUIDING BAR FOR A FLEXIBLE CURTAIN IN A VERTICALLY RAISABLE DOOR

This is a Continuation of U. S. application Ser. No. 07/279,005, filed Dec. 2, 1988, now abandoned.

The present invention relates to a reinforcing and guiding bar for a flexible curtain in a vertically raisable door.

BACKGROUND OF THE INVENTION

There are numerous types of vertically raisable flexible curtain doors. All of these types of door share the common feature of a flexible curtain, e.g. made of plastic-impregnated cloth, two vertical guiding slideways on either side of the door, and an actuator system. They differ essentially in the ways they operate and in the widths of their side guideways, which are generally constituted by channel section bar.

In a first type of door, the flexible curtain is designed to be raised by being wound around a motor-driven shaft extending over the door. While it is being raised, the curtain remains in a single vertical plane and as a result the side guideways holding it are narrow in width.

In a second type of door, the flexible curtain is designed to be raised by being wound around a bar fixed to its bottom edge. Two straps (at least) are looped around the curtain with each strap having one end fixed to a fixed point situated at the level of the door's lintel, and having its other end fixed to a shaft extending over the door, with said shaft being rotated by a motor. As they are wound round the shaft, the straps cause the curtain to be wound around the bar, thereby raising the curtain. Since the diameter of the roll of curtain increases during curtain-raising, the side guideways must be at least as wide as the diameter of the fully-wound curtain.

In a third type of door, the flexible curtain is designed to be raised by being folded, concertina-like. It comprises a plurality of regularly spaced-apart horizontal hinge bars which are connected to loops through which vertical straps are passed with one end of each strap being fixed to the bottom hinge bar and with the other end being fixed to a motor-driven shaft extending over the door. Since the curtain forms a bundle of increasing volume while the door is being opened, the width of the side guideways is not less than the width of the curtain when completely folded.

In all of these three types of door, the flexible curtain has a bar fixed to its bottom edge. A concertina-type door must include, and the other two types of door may include, additional horizontal reinforcing bars which are regularly spaced apart and which are intended to stiffen the curtain. These reinforcing bars are generally slid into sheaths provided on one of the faces of the curtain and they are essential for curtains giving access to the outside and therefore exposed to the wind. This is particularly true of quick-acting doors sometimes referred to as "goods-handling" doors giving access to warehouses and similar storage premises.

There are several different ways in which the flexible curtain fitted with its bar(s) may be positioned relative to the channel section side guideways, regardless of guideway width: firstly the side edges of the flexible curtain itself may be received or may not be received in the guideways; secondly, apart from the bottom bar which is always received therein, other reinforcing bars (which constitute hinges or concertina-type doors) may or may not be received therein, or only some of them may be so received.

In any event, the bottom bar and optionally such reinforcing bars as are also received in the guideways, serve(s) to prevent the curtain from escaping from the plane of the door when subjected to thrust. Although this way of using bars is desirable and even sought-after when the curtain is subjected to a thrust which is uniformly distributed over its area (e.g. wind), it is, on the contrary, detrimental when the curtain is subjected to a violent thrust exerted on a small area. The above-mentioned goods-handling doors which are opened and closed several tens of a times a day to allow goods-handling and/or transportation vehicles to pass through are particularly exposed to thrust of this type. For example, when a vehicle backs into a curtain stiffened by reinforcing bars which are received in the side risers, the curtain is prevented from escaping from the plane of the door and it often happens that the curtain is torn and some of the bars are irreversibly deformed. The door is then no longer operable, at least for as long as it takes for the deformed bars to be replaced. The traffic between the inside and the outside which would normally pass through the door is interrupted for the time being, such that in addition to the cost of repairing the damaged door, there is also the cost of lost business.

The present invention seeks to remedy these drawbacks by providing a reinforcing and guiding bar for a flexible curtain in a vertically raisable door where the bar allows the curtain to escape from the side guideways when subjected to a given amount of thrust.

SUMMARY OF THE INVENTION

According to the invention, a reinforcing and guiding bar for a flexible curtain of a vertically raisable door including two vertical side guideways, includes a zone of reduced mechanical strength at each of its ends, thereby enabling the bar to escape from the guideways when subjected to a thrust of determined magnitude substantially perpendicularly to the curtain.

Advantageously, a stiffening and guiding bar in accordance with the invention comprises:

a tubular portion which is shorter than the distance between the guideways; and two protective end pieces fitted to respective ones of the tubular portion. These end pieces are designed to fold or to come apart or to break in the event of the bar being subjected to a thrust of determined force acting substantially perpendicularly to the curtain.

BRIEF DESCRIPTION OF THE DRAWING

Embodiments of the invention are described by way of example with reference to the accompanying drawing, in which.

MORE DETAILED DESCRIPTION

Figure 1:
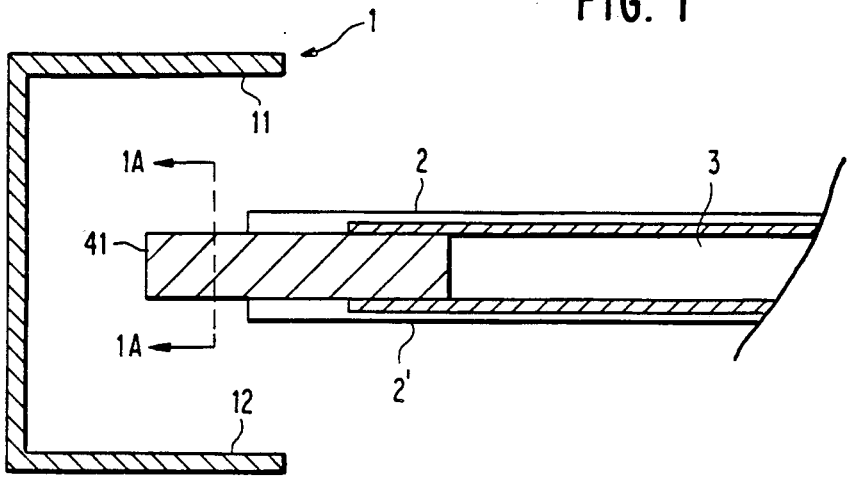
FIG. 1 is a section view through a portion of a flexible curtain door including a first embodiment of a reinforcing and guiding bar in accordance with the invention, with the section being on a horizontal plane including the longitudinal axis of said bar.
Figure 2:
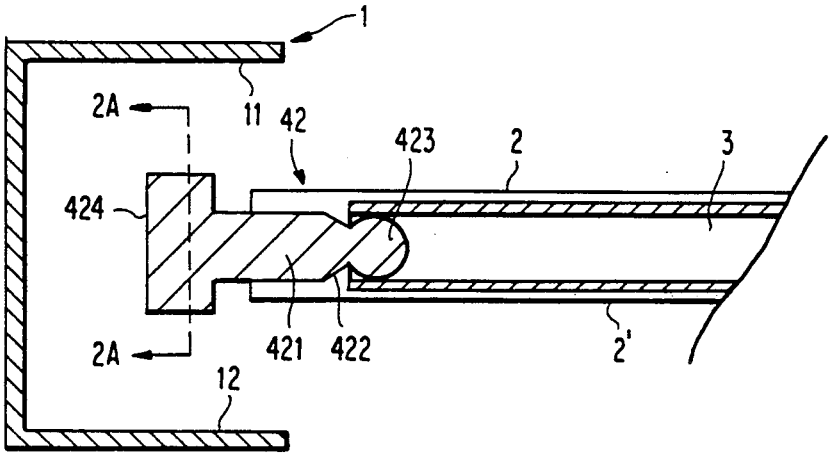
FIG. 2 is a section view through a portion of a flexible curtain door including a second embodiment of a reinforcing and guiding bar in accordance with the invention, with the section being on a horizontal plane including the longitudinal axis of said bar.
Figure 3:
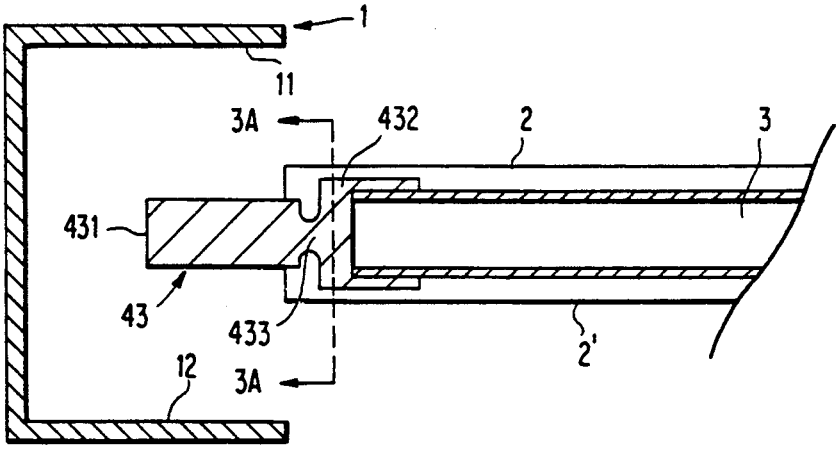
FIG. 3 is a section view through a portion of a flexible curtain door including a third embodiment of a reinforcing and guiding bar in accordance with the invention, with the section being on a horizontal plane including the longitudinal axis of said bar.

FIGS. 1, 2, and 3 show one of the two risers 1 of a concertina-type door. This riser is constituted by a vertical channel section bar capable of carrying and supporting the end of a lintel-forming beam. The essential function of the riser 1 is a function of guiding the side edges of a flexible curtain 2 including at least one horizontal sheath 2' fixed thereto. A reinforcing and guiding bar comprising a tube 3 which is shorter than the distance between the two facing riser 1 is slid into the, or each, sheath 2'. A protective end piece is fitted to each end of the tube 3, and the lengths of the protective end pieces are such that a bar constituted by a tube 3 provided with two end pieces is longer than the distance between the two risers 1. Each protective end piece therefore penetrates into the corresponding riser 1 and prevents the curtain 1 from escaping from the plane of the door.

The essential feature of the protective end pieces 41, 42, and 43 as shown in FIGS. 1, 2, and 3, respectively, is that under normal operating condictions they prevent the curtain 1 from escaping from the plane of the door, i.e. from the risers 1. Thus, the curtain of a closed door when subjected to the action of the wind, even when the wind is violent, will remain in place, i.e. it will continue to be contained in the space delimited by the risers 1. In contrast, the protective end pieces 41, 42, and 43 are designed to allow the curtain to escape from the risers 1 in the event of the curtain being struck with force, e.g. by a vehicle.

Figure 1A:
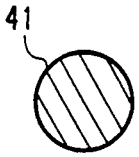
FIG. 1A is a sectional view taken along the line IA—IA in FIG. 1.

The protective end piece 41 shown in FIGS. 1 and 1A constituted by an oblong body made of flexible plastic material and force-fitted into the end of the tube 3. This end piece is advantageously cylindrical over at least that portion of its length which is intended to be received in the end of the tube 3, with the diameter of said cylindrical portion being slightly greater than the inside diameter of the tube.

Figure 2A:
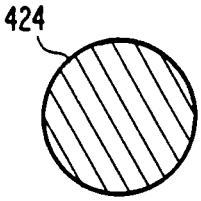
FIG. 2A is a sectional view taken along the line IIA—IIA in FIG. 2.

The protective end piece 42 shown in FIGS. 2 and 2A comprises an oblong body 421 made of stiff plastic material having a sphere 423 at one end thereof connected thereto via a neck 422. At the other end of the body 421, there is a cylindrical portion 424 of greater width intended to prevent the curtain 2 and the sheath 2' from rubbing against the inside surfaces of the flanges 11 and 12 of the riser 1. The protective end piece 42 is forced into the tube 3 over a length such that the end of the tube coincides with the neck 422. As a result, when the reinforcing bar is subjected to a force of given magnitude perpendicular to its axis, the protective end piece comes into contact with one of the flanges 11 and 12 of the riser 1, pivots about its sphere 423, and ends up escaping from the tube and dropping to the ground, with the sphere 423 and the end of the tube 3 behaving, under these circumstances, as a ball-and-socket joint.

Figure 3A:
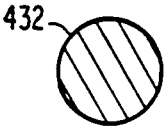
FIG. 3A is a sectional view taken along the line III—IIIA in FIG. 3.

The protective end piece 43 shown in FIGS. 3 and 3A comprises a head 431 connected to a cylindrical sleeve 432 by a thin spacer 433. The sleeve 432 fits over the end of the stiffening bar 3. The protective end piece 43 is made of a rigid breakable material such that if the head 431 strikes one of the flanges 11 or 12 of the riser 1 with sufficient violence, it breaks in two at the spacer 433.

Regardless of whether the protective end piece of the invention folds, comes apart, or breaks when sufficient force is applied thereto, it serves under normal conditions to cooperate with the side guideways in order to guide the flexible curtain for normal operation of a goods-handling door. In addition, it provides the functions of protecting the flexible curtain and the tubular portions of any reinforcing bars stiffening the curtain in the event of the flexible curtain being subjected to a sufficiently violent shock. It is easily manufactured, by being molded out of plastic material, and it is particularly simple to install and replace.

The present invention is not limited to the above-described embodiments. Modifications and verifications may be made thereto by the person skilled in the art.

I claim:

1. A flexible curtain reinforced with horizontal bars, and two vertical side guideways for guiding the ends of said bars, wherein said bars include zone defining means (41; 42; 43) defining at each of said ends a zone of mechanical strength less than the strength of said bars, to enable the portion of at least one end of one of said bars penetrated in said guideways to be broken before the bars are permanently bent when subjected to a thrust of predetermined magnitude directed substantially perpendicularly to the curtain, wherein each of said bars comprises a tubular portion (3) which is shorter than the distance between the guideways; and wherein said zone defining means comprises two protective end pieces of mechanical strength less than the strength of said tubular portion, fitted to respective opposite ends of the tubular portion, wherein the protective end pieces (42) are rigid and each comprise a guiding body (421, 424) connected to a sphere (423), said sphere being received in an end of the tubular portion such that in conjunction with said end it constitutes a ball-and-socket connection capable of coming apart.

2. A flexible curtain reinforced with horizontal bars, and two vertical side guideways for guiding the ends of said bars, wherein said bars include zone defining means (41; 42; 43) defining at each of said ends a zone of mechanical strength less than the strength of said bars, to enable the portion of at least one end of one of said bars penetrated in said guideways to be broken before the bars are permanently bent when subjected to a thrust of predetermined magnitude directed substantially perpendicularly to the curtain, wherein each of said bars comprises a tubular portion (3) which is shorter than the distance between the guideways; and wherein said zone defining means comprises two protective end pieces of mechanical strength less than the strength of said tubular portion, fitted to respective opposite ends of the tubular portion, wherein the protective end pieces (43) are rigid and each include a guide head (431) and a breakable spacer (433) connecting said guide head to a portion (432) which is fittable to the tubular portion.

* * * * *